United States Patent [19]

English

[11] Patent Number: 4,508,514

[45] Date of Patent: Apr. 2, 1985

[54] SINGLE-ENDED METAL HALIDE DISCHARGE LAMP ARC GAP FABRICATING PROCESS

[75] Inventor: George J. English, Reading, Mass.

[73] Assignee: GTE Products Corporation, Stamford, Conn.

[21] Appl. No.: 533,718

[22] Filed: Sep. 19, 1983

[51] Int. Cl.[3] ..... H01J 9/14

[52] U.S. Cl. ..... 445/26; 445/35; 219/121 LF

[58] Field of Search ..... 445/26, 27, 33, 35; 219/121 LF, 121 LG, 121 LJ, 121 EH, 121 EK

[56] References Cited

U.S. PATENT DOCUMENTS

| | | | |
|---|---|---|---|
| 3,716,899 | 2/1973 | Kerstetter et al. | 445/35 |
| 3,792,224 | 2/1974 | Petro et al. | 219/121 LF |
| 3,904,908 | 9/1975 | Wolfe et al. | 445/27 |
| 4,161,672 | 7/1979 | Cap et al. | 313/620 |
| 4,340,836 | 7/1982 | Bergman et al. | 313/631 |

*Primary Examiner*—Kenneth J. Ramsey

*Attorney, Agent, or Firm*—Thomas H. Buffton

[57] ABSTRACT

A process for fabricating metal halide discharge lamps wherein a tungsten rod has a pair of spaced starting coils attached thereto and is connected to an electrical conductor. A pair of notches are ground in the tungsten rod adjacent and intermediate the attached coils and the tungsten rod is sealed into a quartz envelope. A laser beam is focused onto the notches of the tungsten rod through the quartz envelope to sever the tungsten rod and provide an arc gap of a given uniform length.

19 Claims, 12 Drawing Figures

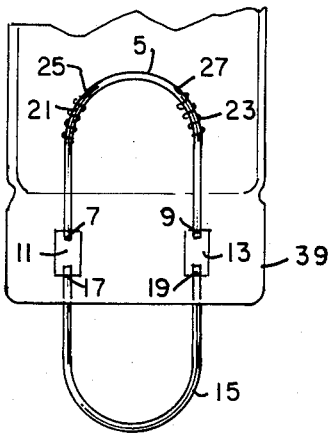
FIG. 1g
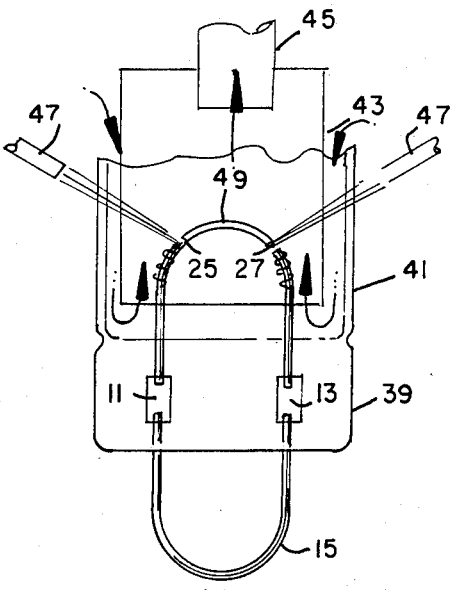
FIG. 1h
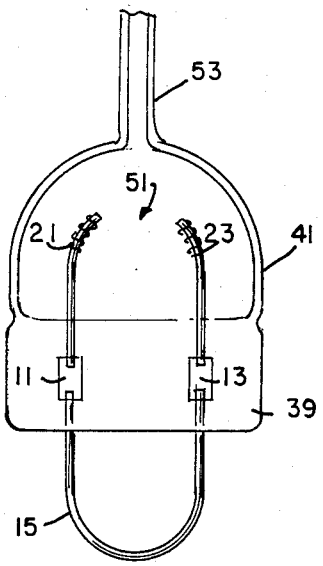
FIG. i
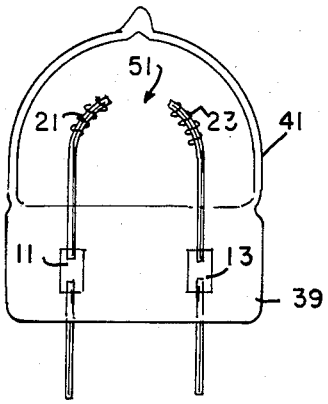
FIG. j

SINGLE-ENDED METAL HALIDE DISCHARGE LAMP ARC GAP FABRICATING PROCESS

CROSS REFERENCE TO RELATED APPLICATIONS

The following co-pending application relates to single-ended metal halide discharge lamps and the manufacture thereof: U.S. Ser. Nos. 502,772; 502,773; 502,774; 502,775 and 502,776.

TECHNICAL FIELD

This invention relates to metal halide discharge lamps and more particularly to a process for manufacturing metal halide discharge lamps having a given arc gap intermediate a pair of electrodes.

BACKGROUND ART

The tungsten lamp is and has been the most common source of light for applications requiring a relatively intense light source such as projectors, optical lens systems and similar applications. Unfortunately, such structures are configured in a manner which tends to develop undesired heat and, in turn, necessitates expensive and cumbersome cooling devices located immediately adjacent the light source in order to provide the required cooling. Also, such structures tend to have an inherent problem in that the life of the light source is relatively short, about 10 to 20 hours of operational life, for example. Thus, it is a common practice to replace the light source of the structures each time the system is to be employed. Obviously, the inconvenience and expense of light source replacement each time the apparatus is used leaves much to be desired.

An improvement over the above-described tungsten lamp system is provided by a system utilizing a high intensity discharge lamp as a light source. For example, a common form of HID lamp is the high pressure metal halide discharge lamps as disclosed in U.S. Pat. No. 4,161,672. Therein is disclosed a double-ended arc tube configuration or an arc tube having electrodes sealed into diametrically opposite ends with an evacuated or gas-filled outer envelope. However, the manufacture of such double-ended structures is relatively expensive, and the configuration is obviously not appropriate for use in projectors and similar optic-lens types of apparatus.

An even greater improvement in the provision of a light source for projectors and optic-lens apparatus is set forth in the single-ended metal halide discharge lamps as set forth in U.S. Pat. Nos. 4,302,699; 4,308,483; 4,320,322; 4,321,501 and 4,321,504. All of the above-mentioned patents disclose structure and/or gas fill variations which are suitable to particular applications. However, any one or all of the above-mentioned embodiments leave something to be desired insofar as manufacture and particularly determination of the arc gap between electrodes is concerned.

Additionally, one known attempt to stabilize components disposed within an envelope is set forth in U.S. Pat. No. 3,904,908 issued to Wolfe et al. Therein, a sheet metal frame is employed to support a plurality of electrical components within a quartz envelope. Thereafter, a laser beam is employed to sever the metal frame and isolate the electrical components from one another. Although the configuration does improve structural rigidity, no attempt or consideration whatever is given to the provision of a precise and controlled arc gap either intermediate the severed portions or anywhere else. Moreover, there is no need or requirement for controlled dimensions since there are no critical dimensions or arc gaps but merely the provision of removable support members.

OBJECTS AND SUMMARY OF THE INVENTION

An object of the present invention is to provide an improved process for fabricating metal halide discharge lamps. Another object of the invention is to enhance the arc gap uniformity of metal halide discharge lamps. Still another object of the invention is to improve the planar uniformity of the electrodes of a metal halide discharge lamp. A further object of the invention is to provide an improved process for manufacturing metal halide discharge lamps at reduced cost, improved efficiency and enhanced uniformity.

These and other objects, advantages and capabilities are achieved in one aspect of the invention by an arc tube fabricating process wherein an electrically conductive rod is sealed into a quartz envelope, a laser beam is focused onto the rod to sever said rod and provide an arc gap having a given dimensional length, the quartz envelope is filled with a fill gas and sealed to provide a metal halide discharge lamp.

In another aspect of the invention, a single-ended metal halide discharge lamp is fabricated by cutting a tungsten rod to a given length, bending the tungsten rod into a substantially U-shaped configuration, attaching a pair of spaced starting coils to the configured tungsten rod, grinding a notch into the tungsten rod adjacent each one and intermediate the pair of starting coils, sealing the ends of the tungsten rod into one end of a quartz tube, flushing the quartz tube with an inert gas while focusing a laser beam on the notches to assure severing of the tungsten rod and provision of an arc gap, employing an external force to remove the severed tungsten rod and filling and sealing the quartz tube to provide a single-ended metal halide lamp.

In still another aspect of the invention, a double-ended metal halide discharge lamp is fabricated by a process wherein a tungsten rod is sealed into opposite ends of a quartz tube, shielded and surrounded with a flushing gas, severed to provide an arc gap of a predetermined length, filled with a fill gas and sealed to provide a metal halide discharge lamp.

BRIEF DESCRIPTION OF THE DRAWINGS

FIGS. 1*g* through 1*j* illustrate an enhanced process for fabricating single-ended metal halide discharge lamps.

BEST MODE FOR CARRYING OUT THE INVENTION

Figure 1A:
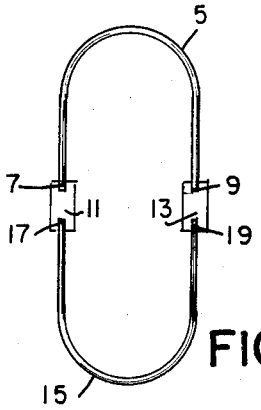
FIGS. 1*a* through 1*f* symbolically illustrate a process for fabricating a single-ended metal halide discharge lamp in accordance with the invention.
Figure 1B:
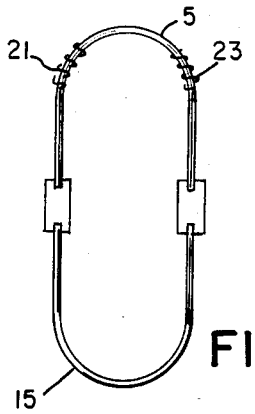
Figure 1C:
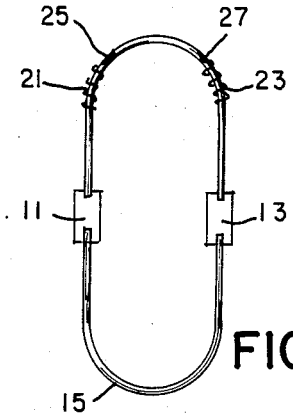
Figure 1D:
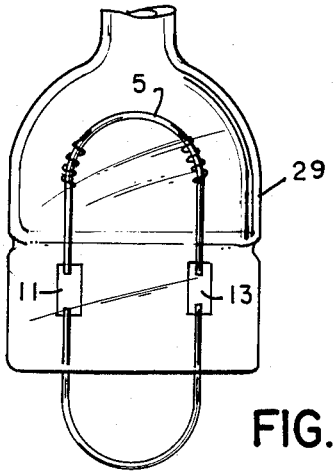
Figure 1E:
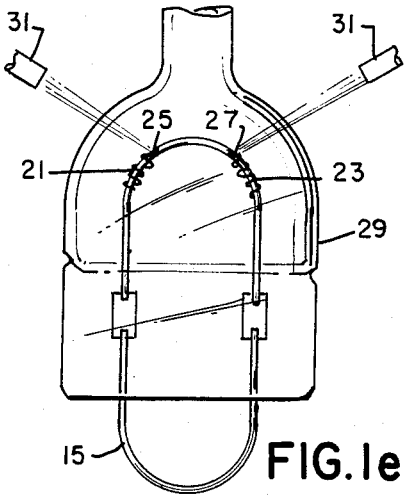
Figure 1F:
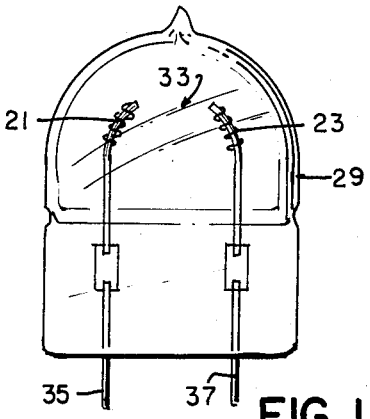

For a better understanding of the present invention, together with other and further objects, advantages, and capabilities thereof, reference is made to the following disclosure and appended claims taken in conjunction with the above-described drawings.

Referring to the drawings, FIGS. 1*a* through 1*f* symbolically illustrate a process for fabricating a single-ended metal halide discharge lamp. Herein, a tungsten rod 5, preferably about 0.5 mm in diameter from a 40-watt metal halide lamp, is selected and cut to a given length. This given length of tungsten rod 5 is bent to a desired configuration, U-shaped for example, and the ends thereof 7 and 9 are each attached to a foil member 11 and 13 respectively. An electrical conductor 15 is preferably formed into a hairpin configuration having a pair of ends 17 and 19 thereof attached to the foil members 11 and 13.

A pair of starting coils 21 and 23 are spacedly affixed to the tungsten rod 5, and notches 25 and 27 are ground into the tungsten rod 5 immediately adjacent each one and intermediate the pair of starting coils 21 and 23. The tungsten rod 5, foiled members 11 and 13 and the electrical conductor 15 are sealed into a quartz envelope 29. More particularly, the tungsten rod 5, foiled members 11 and 13 and electrical conductor 15 are press sealed into one end of a quartz envelope 29.

Thereafter, a laser beam available from a source 31 external to the quartz envelope 19 is focused onto the notches 25 and 27 of the tungsten rod 5. An inert gas is employed to flush the quartz envelope 29 while the laser beam severs the tungsten rod 5 at the notches 25 and 27 to provide an arc gap 33 of a predetermined given length intermediate the starting coils 21 and 23. Moreover, spherical ends may be formed on the tungsten rod 5 at the location of the notches 25 and 27 severed by the laser beam. Also, the severed tungsten rod 5 is removed from the envelope 29 by an external force, such as gravity, for example.

Thereafter, a gas fill of a material such as mercury dosed with a metal halide such as sodium or scandium along with argon is dispensed into the quartz envelope 29. The envelope 29 is then sealed and the electrical conductor 15 is cut to provide a pair of electrical leads 35 and 37 which are suitable for electrically connecting the metal halide discharge lamp to associated electrical apparatus.

Alternatively, FIGS. 1*g* through 1*j* illustrate a single-ended metal halide discharge lamp fabricating process wherein a tungsten rod 5 has a pair of starting coils 21 and 23 attached thereto. A pair of notches 25 and 27 are located adjacent and intermediate the starting coils 21 and 23. The ends 7 and 9 of the tungsten rod 5 are attached to foil members 11 and 13 which, in turn, are attached to the ends 17 and 19 of an electrical conductor or hairpin 15.

The foil members 11 and 13, along with the attached ends 7 and 9 of the tungsten rod 5 and 17 and 19 of the conductor 15, are press-sealed into one end 39 of a quartz tube 41. A shield member 43 having a slot in the bottom thereof is slipped into the quartz tube 41 and telescoped over the tungsten rod 5 and starting coils 21 and 23. Thereafter, flushing gases are introduced into the shield member 43 surrounding the tungsten rod 5 having the notches 25 and 27 therein by way of a flushing tube 45.

Following, a laser beam available from an adjacent source 47 external to the quartz tube 41 is focused onto the notches 25 and 27 of the tungsten rod 5 for a time and in an amount sufficient to sever the tungsten rod 5 providing a severed portion 49. This severed portion 49 of the tungsten rod 5 is expelled from the quartz tube 41 as by gravity, for example. Thus, an arc gap 51 of a predetermined given length intermediate the starting coils 21 and 23 is provided. Moreover, the laser beam may be used to melt back the tungsten rod 5 at the notches 25 and 27 and provide spherical balls thereon whereby the above-described arc gap 51 of a given dimension is provided.

Accordingly, the quartz tube 41 is contoured, as by blow molding for example, to provide exhaust tube 53 for admitting a gas fill such as normally employed in metal halide lamps. Thereafter, the exhaust tube 53 is sealed off to provide a completed single-ended metal halide discharge lamp.

Other arrangements which are applicable but not always necessary include the use of a probe (not shown) inserted through the flushing tube 45 to positionally locate the tungsten rod 5 prior to and during the utilization of a laser beam to effect the previously-mentioned severing thereof. In this manner, the starting coils 21 and 23 as well as the eventually formed arc gap 51 are correctly located with respect to the quartz tube 41. Also, the tungsten rod 5 may be ground in the arc gap area to reduce the metal removal problems associated with the quartz envelope.

Figure 2A:
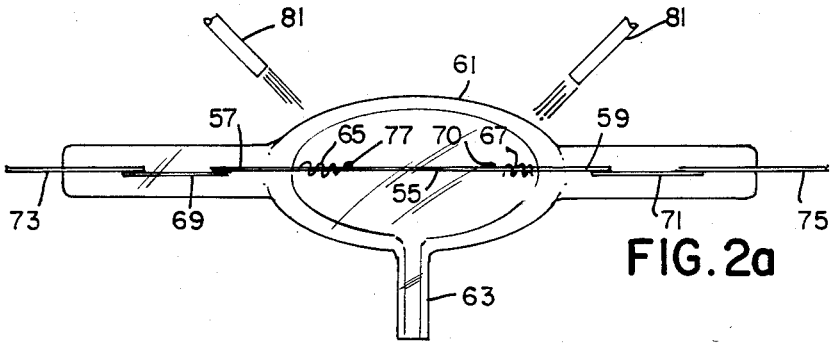
FIGS. 2*a* and 2*b* are cross-sectional illustrations of a double-ended metal halide discharge lamp adaptable to the manufacturing process of FIGS. 1*a* through 1*f*.
Figure 2B:
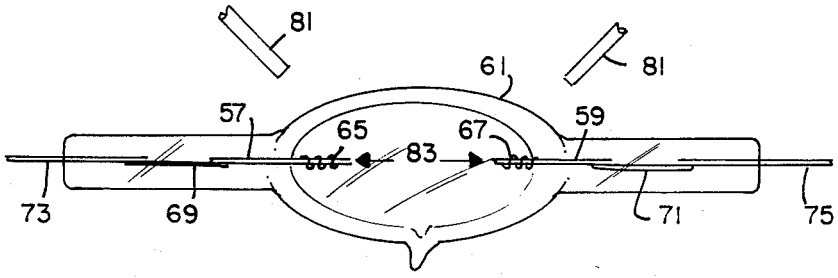

Additionally, FIG. 2 illustrates a preferred form of double-ended metal halide discharge lamp suitable to the above-described process of manufacture. More specifically, a tungsten rod 55 is sealed at opposite ends 57 and 59 into a quartz envelope 61 having an exhaust tube 63 affixed thereto. The tungsten rod 55 has a pair of starting coils 65 and 67 spacedly affixed thereto while the ends of the tungsten rod 55 are attached to foiled members 69 and 71 which are, in turn, attached to a pair of electrical conductors 73 and 75. Also, a pair of notches 77 and 79 are provided in the tungsten rod adjacent each one and intermediate the pair of starting coils 65 and 67.

As in the previously-described process for a single-ended metal halide discharge lamp, a laser beam source 81 is focused to effect severing of the tungsten rod 55 at the notches 77 and 79 and provide an arc gap 83 while a flushing gas is directed onto the notches 77 and 79 to prevent evaporated electrode material from collecting on the sidewalls of the quartz envelope 61. Thereafter, the severed tungsten rod 55 is removed, as by inverting the envelope 61 for example, a fill gas mixture is dispensed within the envelope 61 by way of the exhaust tube 63 and the exhaust tube 63 is sealed off to provide the desired double-ended metal halide discharge device.

Thus, an enhanced process for fabricating metal halide discharge lamps and particularly miniaturized metal halide discharge lamps has been provided. The process is especially applicable to miniaturized metal halide discharge lamps having a volume of less than about 0.3 $cm^3$. Also, the process is efficient and more importantly, insures uniformity and repeatability of the arc gap dimensions and configurations.

While there has been shown and described what is at present considered to be the preferred embodiments of the invention, it will be obvious to those skilled in the art that various changes and modifications may be made therein without departing from the scope of th invention as defined by the appended claims.

What is claimed is:

1. A metal halide discharge lamp fabricating process comprising the steps of:

sealing an electrically conductive rod into a quartz envelope;

focusing a laser beam onto said rod to sever said conductive rod and provide an arc gap having a given dimensional length;

filling said quartz envelope with a fill gas; and sealing said gas filled envelope to provide a metal halide discharge lamp.

2. The discharge lamp fabricating process of claim 1 including the step of spacedly attaching a pair of starting coils to said electrically conductive rod prior to said severing thereof by said laser beam.

3. The discharge lamp fabricating process of claim 1 including the step of notching said conductive rod prior to said severing thereof by said laser beam whereby a reduction in machining of said rod is effected.

4. The discharge lamp fabricating process of claim 1 including the step of cutting said electrically conductive rod to a given length prior to attaching said starting coils.

5. The discharge lamp fabricating process of claim 1 including the step of melting said conductive rod to provide spherical balls on the ends thereof during said severing thereof by said laser beam.

6. The discharge lamp fabricating process of claim 1 including the step of dispensing a flushing gas into said quartz envelope during said severing of said conductive rod whereby vaporized rod is inhibited from depositing onto the walls of said envelope.

7. The discharge lamp fabricating process of claim 1 including the step of utilizing an external force to remove said severed conductive rod from said quartz envelope.

8. The discharge lamp fabricating process of claim 1 including the step of reducing the diameter of the conductive rod prior to the severance of said conductive rod by said laser beam whereby metal removal and evaporation problems are reduced.

9. The discharge lamp fabricating process of claim 1 wherein said fill gas is in the form of mercury dosed with a metal halide and argon.

10. The discharge lamp fabricating process of claim 1 wherein said discharge lamp is in the form of a single-ended metal halide discharge lamp.

11. The discharge lamp fabricating process of claim 1 wherein said lamp is in the form of a double-ended metal halide discharge lamp.

12. The discharge lamp fabricating process of claim 1 including the step of shielding said walls of said quartz envelope during said severing of said conductive rod by said laser beam.

13. A process for fabricating metal halide discharge lamps comprising the steps of:

sealing a tungsten rod into one end of a quartz tube;

shielding said tungsten rod from said quartz tube;

surrounding said shielded tungsten rod with a flushing gas;

severing said tungsten rod to provide an arc gap of a predetermined length;

dispensing a fill gas including a metal halide into said quartz envelope; and sealing said gas-filled quartz envelope to provide a metal halide lamp.

14. The process of claim 13 wherein said metal halide discharge lamp is single-ended.

15. The process of claim 13 wherein said metal halide discharge lamp is double-ended and said tungsten rod is sealed into opposite ends of said quartz tube.

16. The process of claim 13 including the step of employing an external force to remove said severed rod prior to said dispensing of said fill gas into said envelope.

17. The process of claim 13 wherein said fill gas dispensed within said quartz envelope is in the form of argon and mercury dosed with a metal halide.

18. The process of claim 13 including the step of attaching a pair of starting coils to said tungsten rod prior to said sealing of said rod into said quartz tube.

19. The process of claim 13 including the step of machining said tungsten rod prior to said sealing thereof into said quartz tube whereby said severing thereof to provide said arc gap involves a reduced amount of tungsten rod.

* * * * *